United States Patent [19]

Ray

[11] 4,140,525

[45] Feb. 20, 1979

[54] ULTRA-HIGH STRENGTH GLASSY ALLOYS

[75] Inventor: Ranjan Ray, Randolph, N.J.

[73] Assignee: Allied Chemical Corporation, Morris Township, Morris County, N.J.

[21] Appl. No.: 866,676

[22] Filed: Jan. 3, 1978

[51] Int. Cl.[2] ..... C22C 38/22; C22C 38/32

[52] U.S. Cl. ..... 75/126 C; 75/126 P

[58] Field of Search ..... 75/126 C, 126 P

[56] References Cited

U.S. PATENT DOCUMENTS

| | | | |
|---|---|---|---|
| 3,856,513 | 12/1974 | Chen et al. | 75/122 |
| 3,863,700 | 2/1975 | Bedell et al. | 164/87 |
| 3,871,836 | 3/1975 | Polk et al. | 75/122 |
| 3,986,876 | 10/1976 | Masumoto et al. | 75/134 F |
| 4,056,411 | 11/1977 | Chen et al. | 75/122 |
| 4,067,732 | 1/1978 | Ray | 75/126 H |

*Primary Examiner*—Arthur J. Steiner
*Attorney, Agent, or Firm*—Ernest D. Buff

[57] ABSTRACT

Several iron-base glassy alloys in the Fe-Cr-Mo-B system have very high tensile strengths, ranging from about 550 to 700 Kpsi. These alloys consist essentially of about 56 to 68 atom percent iron, about 4 to 9 atom percent chromium, about 1 to 6 atom percent molybdenum and about 27 to 29 atom percent boron plus incidental impurities.

3 Claims, No Drawings

ULTRA-HIGH STRENGTH GLASSY ALLOYS

BACKGROUND OF THE INVENTION

1. Field of the Invention

The invention relates to glassy alloys and, in particular, to glassy alloys in the Fe-Cr-Mo-B system evidencing ultra-high strengths.

2. Description of the Prior Art

High strength alloys in filamentary form are required as reinforcement for composites. Filaments of crystalline alloys have traditionally provided sufficient strength in composites. However, new engineering materials requiring even higher strengths than heretofore provided are necessary. More recently, glassy alloys, such as disclosed in Chen et al., U.S. Pat. No. 3,856,513, have evidenced high ultimate tensile strengths of 500 Kpsi and greater.

Masumoto et al. in U.S. Pat. No. 3,986,867 disclose a number of iron-chromium base glassy alloys. These alloys are disclosed as having excellent mechanical properties, corrosion resistance and heat resistance. Among iron-chromium-boron glassy alloys in which the range of boron is 15 to 20 atom percent, ultimate tensile strengths of 370 to 440 Kpsi are disclosed. For glassy alloys in the Fe-Cr-Mo-P-C-B system in which the boron content is 5 atom percent, ultimate tensile strengths of 480 to 580 Kpsi are disclosed. For glassy alloys in the Fe-Cr-P-C-B system in which the boron content ranges from 25 to 30 atom percent, ultimate tensile strengths of about 525 kpsi are disclosed. However, it is also known that the presence of phosphorus degrades the thermal stability of glassy alloys; see, e.g., Luborsky et al., Journal of Applied Physics, 47, 3648–50 (1976) and Polk et al., U.S. Pat. No. 4,052,201, issued Oct. 4, 1977. The crystallization temperature of the phosphorus-containing alloys of Masumoto et al. is typically about 370° to 515° C.

SUMMARY OF THE INVENTION

In accordance with the invention, ultra-high strength glassy alloys are provided which consist essentially of about 56 to 68 atom percent iron, about 4 to 9 atom percent chromium, about 1 to 6 atom percent molybdenum and about 27 to 29 atom percent boron. These alloys evidence ultimate tensile strengths of least 550 Kpsi and many evidence values approaching 700 Kpsi. Such glassy alloys also evidence greater thermal stability over glassy alloys of similar composition containing phosphorus.

DETAILED DESCRIPTION OF THE INVENTION

The glassy alloys of the invention consist essentially of about 56 to 68 atom percent (69.7 to 86.4 weight percent) iron, about 4 to 9 atom percent (4.7 to 10.4 weight percent) chromium, about 1 to 6 atom percent (2.2 to 12.8 weight percent) molybdenum and about 27 to 29 atom percent (6.6 to 7.0 weight percent) boron, plus incidental impurities. Examples of glassy alloys of the invention include $Fe_{60}Cr_6Mo_6B_{28}$, $Fe_{64}Cr_4Mo_5B_{27}$ and $Fe_{67}Cr_4Mo_1B_{28}$ (the subscripts are in atom percent).

The glassy alloys of the invention evidence ultimate tensile strengths (UTS) of at least about 550 Kpsi, with many compositions having values approaching 700 Kpsi. For example, $Fe_{60}Cr_6Mo_6B_{28}$ has a UTS of 696 Kpsi. Further, the glassy alloys of the invention evidence crystallization temperatures ($T_c$) in excess of 500°

C., with many compositions having values around 600° C. For example, $Fe_{64}Cr_4Mo_5B_{27}$ has a $T_c$ of 603° C.

Deviation from the elements and the amounts listed above results in substantial degradation of properties. For example, reduction of Cr below 4 atom percent results in a reduction of UTS from 620 Kpsi for $Fe_{64}Cr_4Mo_3B_{29}$ to 513 Kpsi for $Fe_{66}Cr_3Mo_3B_{28}$ (decrease of 17.3%). Increase of molybdenum above 6 atom percent results in a reduction of UTS from 595 Kpsi for $Fe_{59}Cr_6Mo_6B_{29}$ to 495 Kpsi for $Fe_{58}Cr_5Mo_{10}B_{27}$ (decrease of 16.9%). Similar decreases in UTS are observed for variations of Fe, Cr, Mo and B greater or less than the values listed above.

The term "glassy", as used herein, means a state of matter in which the component atoms are arranged in a disorderly array; that is, there is no long range order. Such a glassy material gives rise to broad, diffuse diffraction peaks when subjected to electromagnetic radiation in the X-ray region (about 0.01 to 50 A wavelength). This is in contrast to crystalline material, in which the component atoms are arranged in an orderly array, giving rise to sharp diffraction peaks.

The term "filament", as used herein, involves any slender body whose transverse dimensions are much smaller than its length, examples of which include ribbon, wire, strip, sheet and the like of regular or irregular cross-section.

The purity of all materials described is that found in normal commercial practice. However, it is contemplated that minor amounts (up to a few atom percent) of other alloying elements may be present without an unacceptable reduction in the ultimate tensile strength. Such elements may be present either as a result of the source of the primary element or through a later addition. Such additions may be made, for example, to improve glass-forming ability. Examples of suitable additions include the transition metal elements of Groups IB to VIIB and VIII (excluding, of course, those employed in the invention) and metalloid elements of carbon, silicon, aluminum and phosphorus.

The thermal stability of a glassy alloy is an important property in certain applications. Thermal stability is characterized by the time-temperature transformation behavior of an alloy, and may be determined in part by differential thermal analysis (DTA). Glassy alloys with similar crystallization behavior as observed by DTA may exhibit different embrittlement behavior upon exposure to the same heat treatment cycle. By DTA measurement, crystallization temperatures $T_c$ can be accurately determined by heating a glassy alloy (at about 20° to 50° C./min) and noting whether excess heat is evolved over a limited temperature range (crystallization temperatue) or whether excess heat is absorbed over a particular temperature range (glass transition temperature). In general, the glass transition temperature is near the lowest, or first, crystallization temperature $T_c$, and, as is conventional, is the temperature at which the viscosity ranges from about $10^{13}$ to $10^{14}$ poise.

The glassy alloys of the invention are formed by cooling a melt of the desired composition at a rate of at least about $10^{5}$° C./sec. A variety of techniques are available, as is well-known in the art, for fabricating splat-quenched foils and rapid-quenched substantially continuous filaments. Typically, a particular composition is selected, powders or granules of the requisite elements in the desired proportions are melted and homogenized, and the molten alloy is rapidly quenched on a chill surface, such as a rapidly rotating cylinder.

The high strength and high thermal stability of filaments of the glassy alloys of the invention renders them suitable for use as reinforcement in composites for high temperature applications.

EXAMPLES

EXAMPLE 1

Alloys were prepared from constituent elements of high purity (≧99.9%). The elements with total weight of 30 g were melted by induction heater in a quartz crucible under vacuum of $10^{-3}$ Torr. The molten alloy was held at 150° to 200° C. above the liquidus temperature for 10 min and allowed to be completely homogenized before it was slowly cooled to solid state at room temperature. The alloy was fractured and examined for complete homogeneity.

About 10 g of the alloy was remelted to 150° C. above the liquidus temperatures under vacuum of $10^{-3}$ Torr in a quartz crucible having an orifice of 0.010 inch diameter at the bottom. The chill substrate used in the present work was heat-treated beryllium-copper alloy having moderately high strength and high thermal conductivity. The substrate material contained 0.4 to 0.7 wt % beryllium, 2.4 to 2.7 wt % cobalt and copper as balance. The substrate was rotated at a surface speed of about 4000 ft/min. The substrate and the crucible were contained inside a vacuum chamber evacuated to $10^{-3}$ Torr. The melt was spun as a molten jet by applying argon pressure of 5 psi over the melt. The molten jet impinged vertically onto the internal surface of the rotating substrate. The chill cast ribbon was maintained in good contact with the substrate by the centrifugal force acting on the ribbon against the substrate surface. The ribbon was displaced from the substrate by nitrogen gas at 30 psi at a position two-thirds of the circumferential length away from the point of jet impingement. During metallic glass ribbon casting operation, the vacuum chamber was maintained under a dynamic vacuum of 20 Torr. The substrate surface was polished with 320 grit emery paper and cleaned and dried with acetone prior to start of the casting operation. The as-cast ribbons were found to have good edges and surfaces. The ribbons had the following dimensions: 0.001 to 0.002 inch thickness and 0.015 to 0.020 inch width.

Ultimate tensile strength was measured on an Instron testing machine using specimens with unpolished edges in the as-quenched state. The gauge length was 1 inch and the cross-head speed employed was 0.02 in/min.

Crystallization temperature was measured by DTA at a scan rate of about 20° C./min.

The following values of ultimate tensile strength in Kpsi and crystallization temperature in ° C., listed in Table I below, were measured for a number of compositions within the scope of the invention.

TABLE I

Mechanical and Thermal Properties of Glassy Alloys of the Invention

| Alloy Composition (atom %) | | | | Ultimate Tensile Strength, Kpsi | Crystallization Temperature, ° C |
|---|---|---|---|---|---|
| Fe | Cr | Mo | B | | |
| 67 | 4 | 1 | 28 | 675 | |
| 65 | 5 | 3 | 27 | 557 | |
| 65 | 5 | 2 | 28 | 623 | |
| 64 | 4 | 5 | 27 | 640 | 603 |
| 64 | 4 | 4 | 28 | 634 | 580 |
| 64 | 4 | 3 | 29 | 620 | 534 |
| 62 | 9 | 2 | 27 | 589 | |
| 61 | 9 | 1 | 29 | 575 | |
| 60 | 8 | 4 | 28 | 563 | 590 |
| 60 | 8 | 3 | 29 | 603 | |
| 60 | 6 | 6 | 28 | 696 | 623 |
| 59 | 8 | 4 | 29 | 595 | |
| 59 | 6 | 6 | 29 | 595 | |

As can be seen from Table I, the ultimate tensile strengths are in excess of 550 Kpsi, with several compositions having values approaching 700 Kpsi. Further, the crystallization temperature is quite high, being greater than about 530° C., with several compositions having values approaching 600° C.

EXAMPLE 2

Continuous ribbons of several compositions of glassy alloys outside the scope of the invention were fabricated as in Example 1. The following measured values of ultimate tensile strengths of these compositions are listed in Table II below.

TABLE II

Mechanical Properties of Glassy Alloys Outside the Scope of the Invention

| Alloy Composition (atom %) | | | | Element Present in Concentration Outside Limits of Inventive Glassy Alloys | Ultimate Tensile Strength, Kpsi |
|---|---|---|---|---|---|
| Fe | Cr | Mo | B | | |
| 60 | — | — | 20 | Fe,Cr,Mo,B | 500 |
| 65 | — | — | 25 | Fe,Cr,Mo,B | 502 |
| 72 | — | — | 28 | FeCr,Mo | 360 |
| 70 | — | 1 | 29 | Fe,Cr | 380 |
| 68 | 4 | 3 | 25 | B | 507 |
| 66 | 4 | 4 | 26 | B | 509 |
| 66 | 3 | 3 | 28 | Cr | 513 |
| 66 | 2 | 2 | 30 | Cr,B | 395 |
| 66 | — | 7 | 27 | Cr,Mo | 484 |
| 65 | 4 | 1 | 30 | B | 487 |
| 63 | 9 | — | 28 | Mo | 432 |
| 62 | 11 | 1 | 26 | Cr,B | 490 |
| 62 | 5 | 7 | 26 | B,Mo | 458 |
| 62 | 5 | 2 | 31 | B | 402 |
| 61 | 9 | 4 | 26 | B | 518 |
| 60 | 10 | 2 | 28 | Cr | 487 |
| 58 | 5 | 10 | 27 | Mo | 495 |
| 49 | 18 | 4 | 29 | Fe,Cr | 513 |

A comparison between compositions of Tables I and II shows that variation of any of the elements of Fe, Cr, Mo and B outside the limits disclosed above results in a substantial reduction in ultimate tensile strength.

What is claimed is:

1. A substantially totally glassy alloy consisting essentially of about 56 to 68 atom percent iron, about 4 to 9 atom percent chromium, about 1 to 6 atom percent molybdenum and about 27 to 29 atom percent boron, plus incidental impurities.

2. The glassy alloy of claim 1 in the form of a filament.

3. The glassy alloy of claim 1 consisting essentially of a composition selected from the group consisting of $Fe_{60}Cr_6Mo_6B_{28}$, $Fe_{64}Cr_4Mo_5B_{27}$ and $Fe_{67}Cr_4Mo_1B_{28}$.

* * * * *

UNITED STATES PATENT OFFICE

CERTIFICATE OF CORRECTION

Patent No. 4,140,525 Dated February 20, 1979

Inventor(s) Ranjan Ray

It is certified that error appears in the above-identified patent and that said Letters Patent are hereby corrected as shown below:

The term of this patent subsequent to January 10, 1995 has been disclaimed.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*